US006581303B1

(12) United States Patent
Tuan

(10) Patent No.: US 6,581,303 B1
(45) Date of Patent: Jun. 24, 2003

(54) VENTILATING ARRANGEMENT FOR A SHOE

(75) Inventor: Wei-Jei Tuan, Taipei (TW)

(73) Assignee: E.S. Originals, Inc., New York, NY (US)

( * ) Notice: Subject to any disclaimer, the term of this patent is extended or adjusted under 35 U.S.C. 154(b) by 0 days.

(21) Appl. No.: 10/052,022

(22) Filed: Jan. 17, 2002

(51) Int. Cl.[7] ..... A43B 7/06
(52) U.S. Cl. ..... 36/3 B; 36/29
(58) Field of Search ..... 36/3 B, 3 R, 29

(56) References Cited

U.S. PATENT DOCUMENTS 5,287,638 A * 2/1994 Preston ..... 36/3 R
5,299,368 A * 4/1994 Liu ..... 36/3 B
5,815,949 A * 10/1998 Sessa ..... 36/3 B
6,266,898 B1 * 7/2001 Cheng ..... 36/3 B

FOREIGN PATENT DOCUMENTS

GB 2245145 * 1/1992

* cited by examiner

*Primary Examiner*—Ted Kavanaugh
(74) *Attorney, Agent, or Firm*—Kirschstein, et al.

(57) ABSTRACT

A shoe is ventilated by compression and expansion of a pump molded of one-piece with an insert sandwiched between an insole and an outsole. Dome-shaped projections on the insole and outsole are located at opposite sides of the pump.

9 Claims, 5 Drawing Sheets

VENTILATING ARRANGEMENT FOR A SHOE

BACKGROUND OF THE INVENTION

1. Field of the Invention

The present invention generally relates to shoes, especially athletic shoes, and more particularly, to a ventilating arrangement for circulating air through the shoe.

2. Description of the Related Art

Air circulation, especially in a toe region of a shoe, is often inadequate to properly deal with the problem of accumulating odor and moisture, particularly for athletic footwear such as sneakers. The art has attempted to address this issue with permeable, breathable fabrics and with multiple component air pumps built into the shoes. However, the use of breathable fabrics alone has not proven to be effective. The built-in pumps occupy a relatively large spatial volume and create an oversized, often uncomfortable shoe.

SUMMARY OF THE INVENTION

Objects of the Invention

One object of this invention is to provide a ventilated shoe that does not possess the drawbacks of known structures.

Another object of this invention is to ventilate a shoe while it is being worn.

Still another object of this invention is to effectively pump air into and out of the shoe.

Features of the Invention

In keeping with these objects and others which will become apparent hereinafter, one feature of this invention resides in a ventilating arrangement for a shoe. The arrangement includes an outsole extending between heel and toe regions and having an outer ground-engaging surface, an inner surface, raised wall portions located above the inner surface and bounding an interior space, and a heel opening extending between the outer and inner surfaces at the heel region.

The arrangement also includes a molded insert of resilient material and mounted in the interior space. The insert extends between heel and toe portions that overlie the heel and toe regions of the outsole. The insert has a deformable pumping portion of one-piece molded construction with the heel portion, an air channel formed in the insert and extending between the heel and toe portions, and apertures extending through the insert into open communication with the air channel.

In accordance with this invention, a pumping element is mounted on the outsole. The element extends through the heel opening to be exposed at the outer surface of the outsole. The pumping element is pressed against and deforms the pumping portion during use of the shoe for urging air to flow along the air channel to and through the apertures to ventilate the shoe.

In the preferred embodiment, the pumping element is constituted of a harder material than that of the insert. The pumping element is situated with clearance in a bore of the insert. The air channel extends into the clearance.

In use, as a person wearing a shoe having the ventilating arrangement walks or runs, the harder pumping element compresses the pumping portion and pushes air along the air channel. When the person's foot is lifted off the ground, the compressed pumping portion returns to its uncompressed state and draws air into and along the air channel. This air circulation ventilates the shoe.

In contrast to the multiple component air pumps built into prior art shoes, this ventilating arrangement does not employ discrete air bladders or pumps, or separate tubes to distribute the air. The pumping action is directly and efficiently applied by the pumping element which is exposed at the outer, ground-engaging surface of the outsole.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
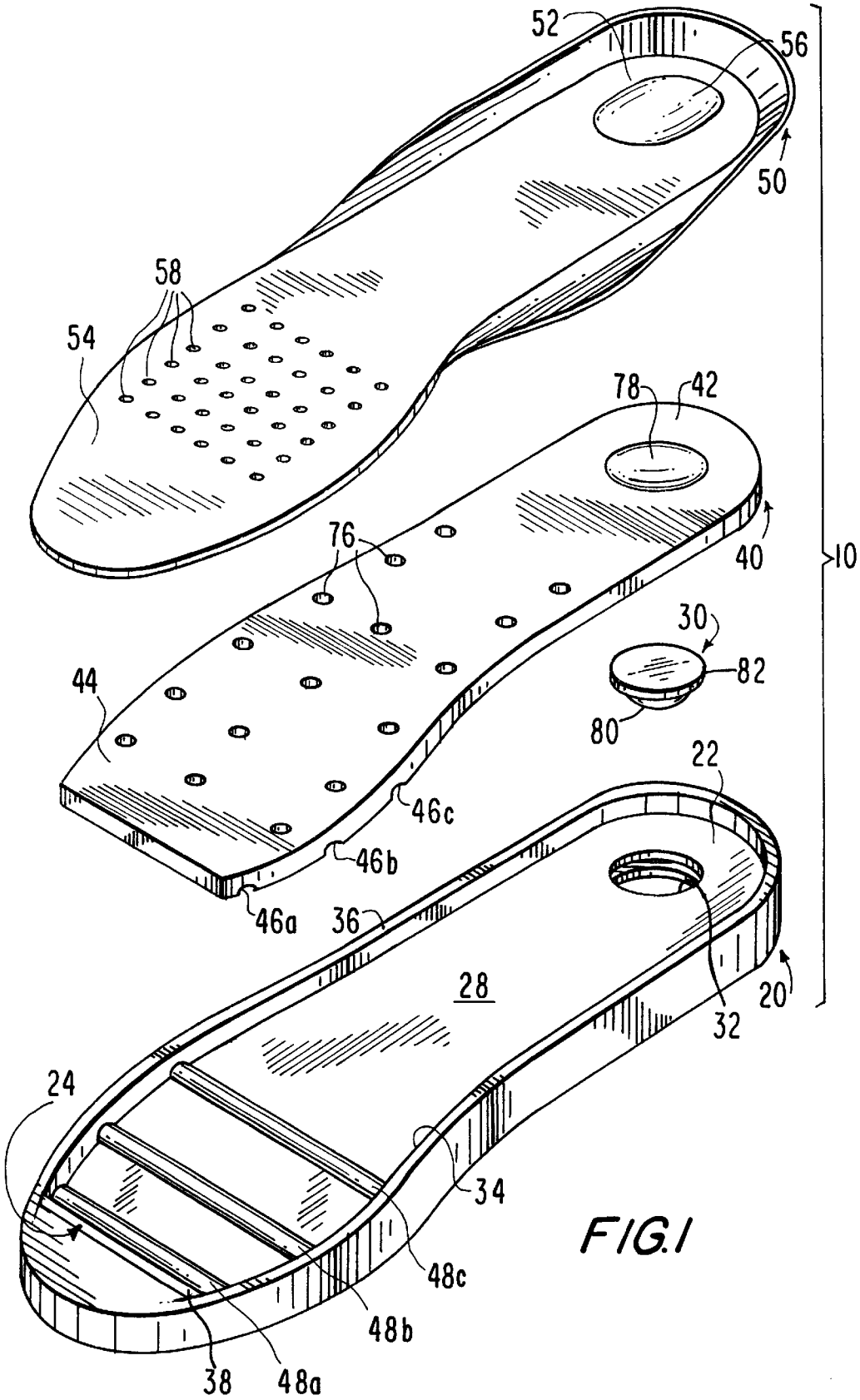
FIG. 1 is an exploded view of a ventilating arrangement in a shoe in accordance with this invention.
Figure 2:
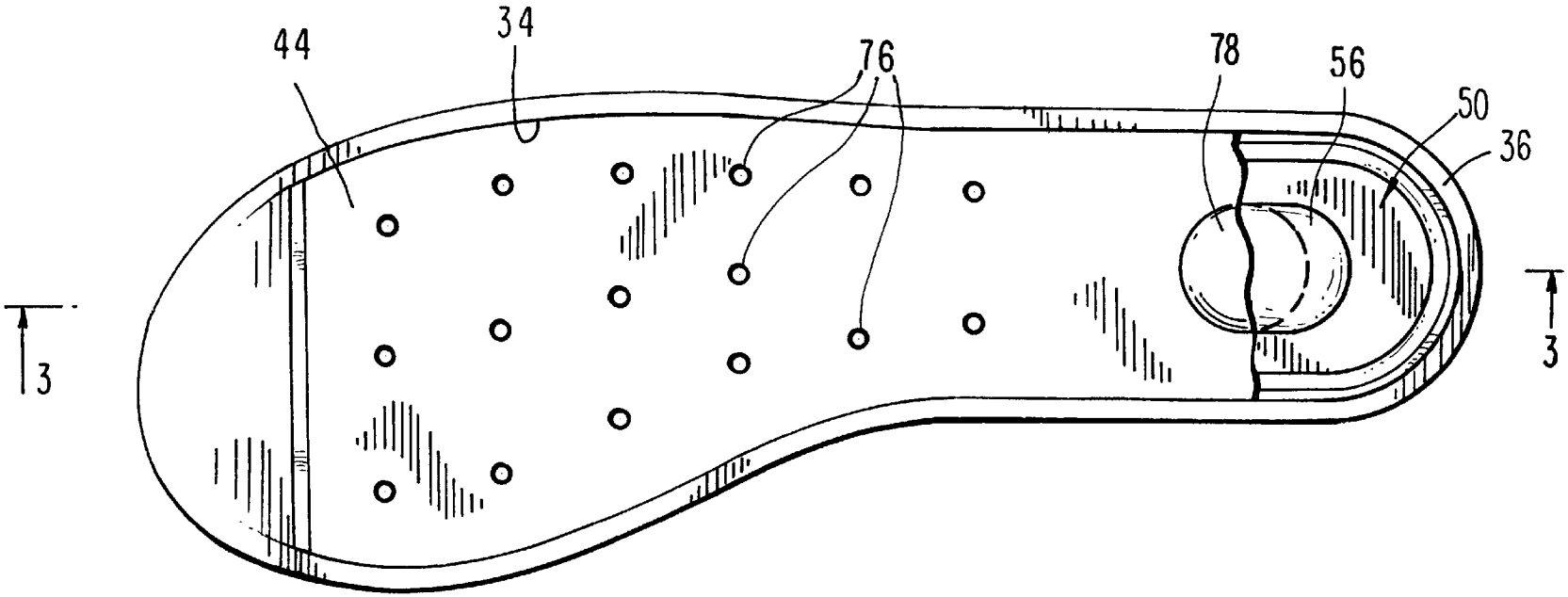
FIG. 2 is a broken-away, top plan view of the assembled arrangement of FIG. 1.

Referring now to the drawings, reference numeral 10 generally identifies a ventilating arrangement for a shoe. The arrangement includes an outsole 20, a pumping element or actuator 30, a molded insert 40, and an optional insole 50. The remainder of the shoe, especially the upper, has not been shown in order not to unduly encumber the drawings.

Figure 5:
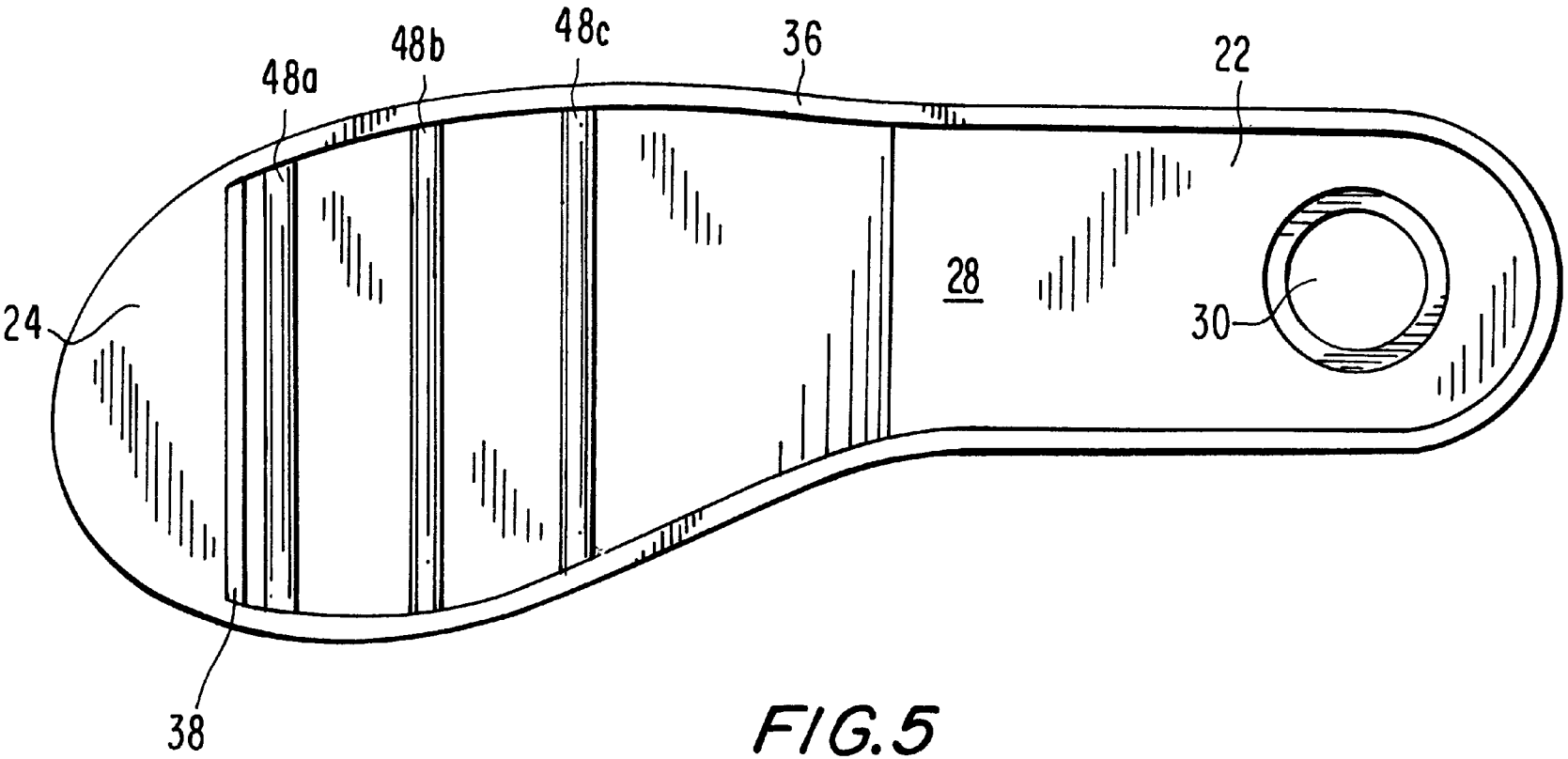
FIG. 5 is a plan view of a top of an outsole used in the arrangement of FIG. 1.

The outsole 20 extends generally along a longitudinal direction between a heel region 22 and a toe region 24. The outsole has an outer, ground-engaging surface 26 (see FIG. 3) and an inner surface 28 (see FIG. 5). A heel opening 32 (see FIG. 1) extends between the outer and inner surfaces 26, 28 at the heel region 22.

The outsole has raised wall portions located above the inner surface 28 and bounding an inner space 34. The raised wall portions include a peripheral boundary wall 36 extending around both lateral sides and the heel region of the outsole, except at the toe region. A front abutment wall 38 cooperates with the boundary wall 36 to define the space 34.

Figure 4:
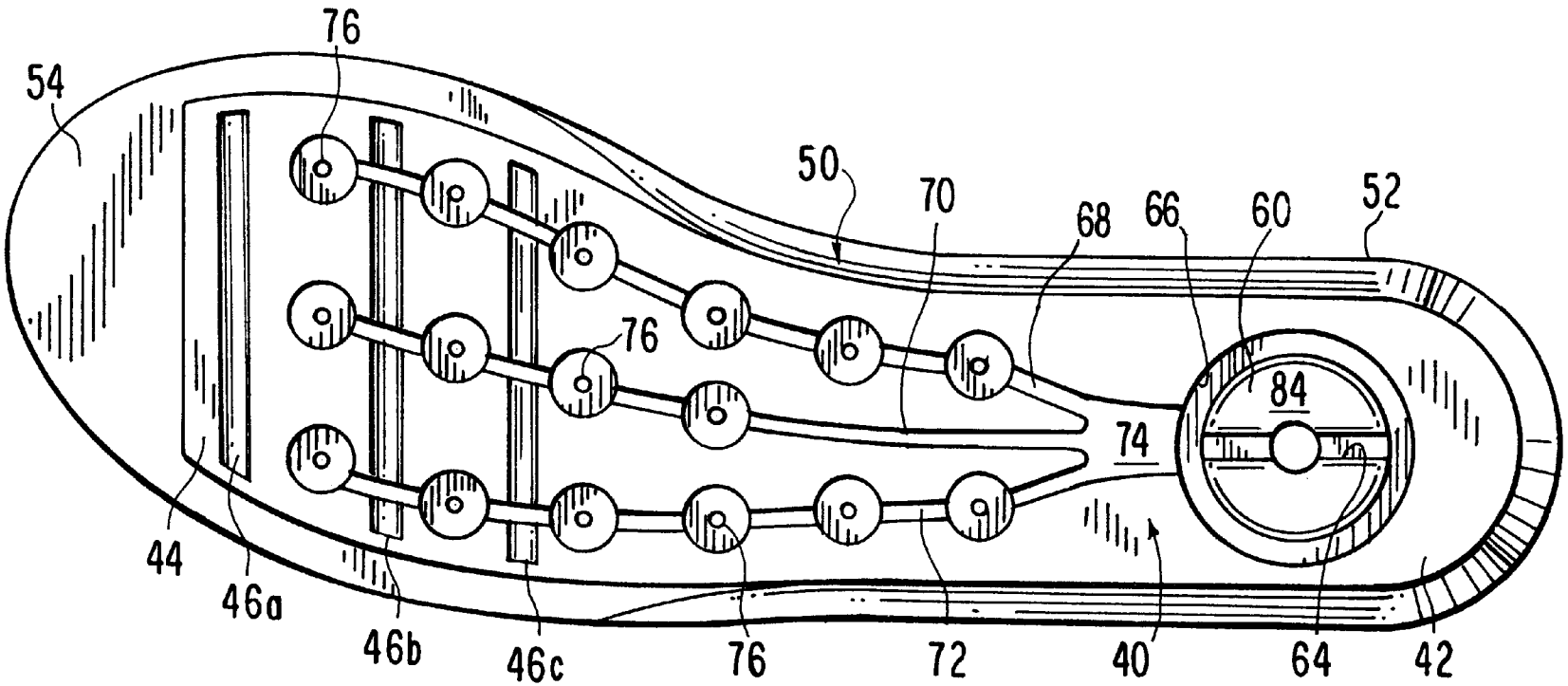
FIG. 4 is a plan view of a bottom of a molded insert used in the arrangement of FIG. 1.

The insert 40 is mounted in the space 34 and is held in position by the boundary wall 36 and the abutment wall 38. The insert 40 is constituted of a resilient material such as a blown rubber and is deformable. The insert 40 extends between a heel portion 42 and a toe portion 44 that respectively overlie the heel and toe regions 22, 24. As best seen in FIG. 4, the bottom of the insert has a plurality of transverse grooves 46*a, b, c* that receive a corresponding plurality of transverse ribs 48 *a, b, c* on the inner surface 28 of the outsole and assist in positioning and retaining the insert within the space 34.

The insole 50 overlies the insert 40 and includes a heel section 52 and a toe section 54 respectively overlying the heel and toe portions 42, 44. A wear-resistant, durable pad 56 is located at the heel section 52. Apertures 58 are arranged at the toe section 54.

A pumping portion 60 is molded of one-piece with the insert at the heel portion 42. The pumping portion 60 is a solid, frusto-conical block having a blind bore 62 extending into a trench 64 that is formed across the pumping portion along the longitudinal direction. The pumping portion 60 is received in an annular clearance 66 which is in air flow communication with the trench 64 and the bore 62.

The clearance 66 is also in open communication with an air channel formed in the insert. The air channel includes a plurality of air passageways 68, 70, 72 intersecting at, and extending from, a common mouth or junction 74, towards the toe portion 44 along separate paths. A plurality of apertures 76 extends through the insert and into air flow communication with the air passageways at spaced-apart intervals along each passageway.

An upper dome-shaped projection 78 is formed on the top of the heel portion of the insert. This projection 78 is sandwiched between the durable pad 56 on the insole and the pumping portion 60 at the bottom of the insert.

Figure 3:
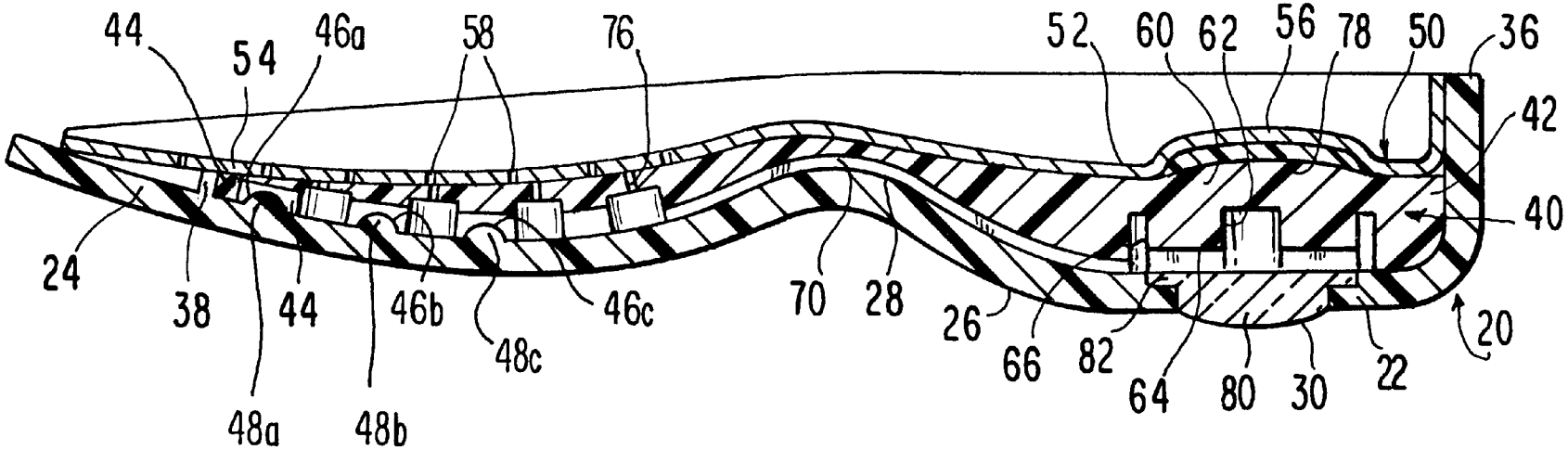
FIG. 3 is a sectional view taken on line 3—3 of FIG. 2.

As best seen in FIG. 3, the pumping element 30 has a lower, dome-shaped actuator or button 80 that extends through the heel opening 32, and a circular base 82 that overlies a circular base wall 84 of the pumping portion 60. The button 80 is exposed at the outer surface 26 of the outsole. The element 30 is constituted of a harder material than that of the insert.

In use, as a person wearing a shoe equipped with the ventilating arrangement 10 walks or runs, every time that the person's heel impacts on the ground, the button 80 is pushed upwardly, and the dome-shaped projection 78 is pushed downwardly, thereby compressing the pumping portion 60. When the person's heel is lifted off the ground, the compressed pumping portion 60 expands and returns to its initial uncompressed state. The alternate compression and expansion of the pumping portion causes air to be drawn into, and discharged from, the apertures 58, 76. The air travels in both directions along a path extending between the apertures 58, apertures 76, passageways 68, 70, 72, junction 74, clearance 66, trench 64, and blind bore 62. In a varied construction, another aperture is formed through the dome-shaped projection 78 into the bore 62 so as to provide another vent through which air is admitted or discharged.

It will be understood that each of the elements described above, or two or more together, also may find a useful application in other types of constructions differing from the types described above.

While the invention has been illustrated and described as embodied in a ventilating arrangement for a shoe, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

I claim:

1. A ventilating arrangement for a shoe, comprising:

a) an outsole extending between heel and toe regions and having an outer ground-engaging surface, an inner surface, raised wall portions located above the inner surface and bounding an interior space, and a heel opening extending between the outer and inner surfaces at the heel region;

b) a molded insert of resilient material and mounted in the interior space, the insert extending between heel and toe portions that overlie the heel and toe regions of the outsole, the insert having a deformable pumping portion of one-piece molded construction with the heel portion, an air channel formed in the insert and extending between the heel and toe portions, and apertures extending through the insert into open communication with the air channel; and c) a pumping element mounted on the outsole and extending through the heel opening to be exposed at the outer surface of the outsole, the pumping element being pressed against and deforming the pumping portion during use of the shoe for urging air to flow along the air channel to and through the apertures to ventilate the shoe.

2. The ventilating arrangement of claim 1, wherein the inner surface has ribs, and wherein the insert has grooves for receiving the ribs to retain the insert in the interior space.

3. The ventilating arrangement of claim 1, wherein the raised wall portions include a peripheral wall portion extending around and engaging a peripheral surface of the insert.

4. The ventilating arrangement of claim 1, wherein the heel opening is circular, and wherein the pumping element includes a circular disc portion situated in the heel opening.

5. The ventilating arrangement of claim 1, wherein the molded insert is constituted of an elastomeric material having a predetermined hardness, and wherein the pumping element is constituted of a material having a hardness greater than said predetermined hardness.

6. The ventilating arrangement of claim 1, wherein the air channel includes a plurality of passageways intersecting at a common junction.

7. The ventilating arrangement of claim 6, wherein the apertures are spaced apart along each passageway.

8. The ventilating arrangement of claim 1, wherein the insert includes a bore of circular cross-section, and wherein the pumping portion is situated in the bore with clearance, and wherein the air channel extends into the clearance.

9. The ventilating arrangement of claim 8, wherein the pumping portion has a passage extending therethrough to the clearance.

* * * * *